US005546635A

United States Patent [19]

Leifeld

[11] Patent Number: 5,546,635

[45] Date of Patent: Aug. 20, 1996

[54] APPARATUS FOR CLEANING AND OPENING FIBER TUFTS

[75] Inventor: Ferdinand Leifeld, Kempen, Germany

[73] Assignee: Trützschler GmbH & Co. KG, Mönchengladbach, Germany

[21] Appl. No.: 288,053

[22] Filed: Aug. 10, 1994

Related U.S. Application Data

[63] Continuation-in-part of Ser. No. 858,524, Mar. 27, 1992, abandoned.

[30] Foreign Application Priority Data

Mar. 28, 1991 [DE] Germany ..... 41 10 297.5

[51] Int. Cl.[6] ..... D01G 9/14

[52] U.S. Cl. ..... 19/200; 19/65 R

[58] Field of Search ..... 19/105, 200, 201, 19/202, 203, 204, 205, 112, 114, 65 R

[56] References Cited

U.S. PATENT DOCUMENTS

| | | | |
|---|---|---|---|
| 2,014,673 | 9/1935 | Setzer | 19/112 |
| 4,686,744 | 8/1987 | Shofner | 19/105 |
| 5,333,358 | 8/1994 | Leifeld | 19/105 |

FOREIGN PATENT DOCUMENTS

| | | |
|---|---|---|
| 602808 | 9/1934 | Germany . |
| 2634768 | 5/1985 | Germany . |
| 3937899 | 1/1991 | Germany . |
| 3490510 | 3/1991 | Germany . |
| 1052575 | 11/1983 | U.S.S.R. . |
| 184867 | 8/1922 | United Kingdom . |
| 890217 | 2/1962 | United Kingdom . |
| 995281 | 6/1965 | United Kingdom . |
| 1012675 | 12/1965 | United Kingdom . |
| 1530769 | 11/1978 | United Kingdom . |

*Primary Examiner*—C. D. Crowder
*Assistant Examiner*—Larry D. Worrell, Jr.
*Attorney, Agent, or Firm*—Spencer & Frank

[57] ABSTRACT

An apparatus for cleaning and opening fiber tufts includes a feeding device and an opening device adjoining the feeding device for receiving fiber tufts therefrom. The device has a series of immediately consecutive, mutually cooperating fiber processing rolls each having a point density which increases from roll to roll as viewed in a direction of fiber material advance through the roll series of the opening device.

6 Claims, 4 Drawing Sheets

APPARATUS FOR CLEANING AND OPENING FIBER TUFTS

CROSS REFERENCE TO RELATED APPLICATION

This application is a continuation-in-part of U.S. application Ser. No. 07/858,524, filed Mar. 27, 1992 now abandoned.

BACKGROUND OF THE INVENTION

This invention relates to an apparatus for cleaning and opening fiber tufts, particularly cotton and synthetic fiber tufts wherein the fiber tufts, forming a fiber mass, pass through a feeding device such as a feed roll cooperating with a feed tray or a pair of feed rolls. Thereafter the fiber mass passes through an opening device formed, for example, of an opening roll which may be a needle roll or a fully spiked roll and thereafter the fiber material is advanced to a successive fiber processing machine.

In a known apparatus a fully spiked roll is provided which, as an opening roll, cooperates with a screen positioned therebelow. The screen surface has a plurality of passages such as holes or narrow slots whose length dimension is oriented parallel to the axis of the fully spiked roll. The screen is coaxial with the fully spiked roll and is at a distance from the beating circle of the pins so that the fiber material is guided over the screen. A planar horizontal cover is positioned above the fully spiked roll which is associated with a pneumatic device for removing the fiber material. The impurities pass through the apertures of the screen and are collected in a large waste chamber. It is a disadvantage of this prior art construction that the screen is expensive to manufacture and further, the screen apertures may become clogged during operation, particularly if the cotton undergoing processing is contaminated with sticky substances such as honeydew. Such occurrence adversely affects the cleaning efficiency. It is a further disadvantage of the prior art construction that upon increasing the circumferential speed of the fully spiked roll a damage to the fibers by the vigorous working of the pins on the slowly advanced fiber material may occur and therefore limits have to be set for the circumferential roll speed.

SUMMARY OF THE INVENTION

It is an object of the invention to provide an improved apparatus of the above-outlined type from which the discussed disadvantages are eliminated and which in particular makes possible a gentle opening and an improved cleaning of fiber material.

This object and others to become apparent as the specification progresses, are accomplished by the invention, according to which, briefly stated, the apparatus for cleaning and opening fiber tufts includes a feeding device and an opening device adjoining the feeding device for receiving fiber tufts therefrom. The opening device has a series of at least two immediately consecutive, differently structured fiber processing rolls, having spikes, needles or sawteeth, wherein each roll in the series has a spike, needle or sawtooth point density which is greater than that of any upstream-arranged roll of the series, as viewed in the direction of fiber run through the roll series.

By virtue of the invention, a separation of functions is achieved. Immediately downstream of the feeding device a relatively slowly rotating roll of the roll series is arranged; it combs the slowly advanced fiber material without damaging the same and perform a first cleaning thereof. The immediately following second roll takes over the already-accelerated fiber material, rotates with a higher circumferential speed than the first roll, whereby a more pronounced cleaning of the fiber material is achieved. In this manner the fiber material is exposed to a gradual acceleration. The fiber opening operation is stepped and, by virtue of the gradual acceleration, is treated gently. At the same time, by at least doubling the number of the cleaning rolls coupled with downstream increasing the circumferential speed and downstream increasing density of the roll clothing, a significantly increased cleaning effect is achieved.

DESCRIPTION OF THE PREFERRED EMBODIMENTS

Figure 1:
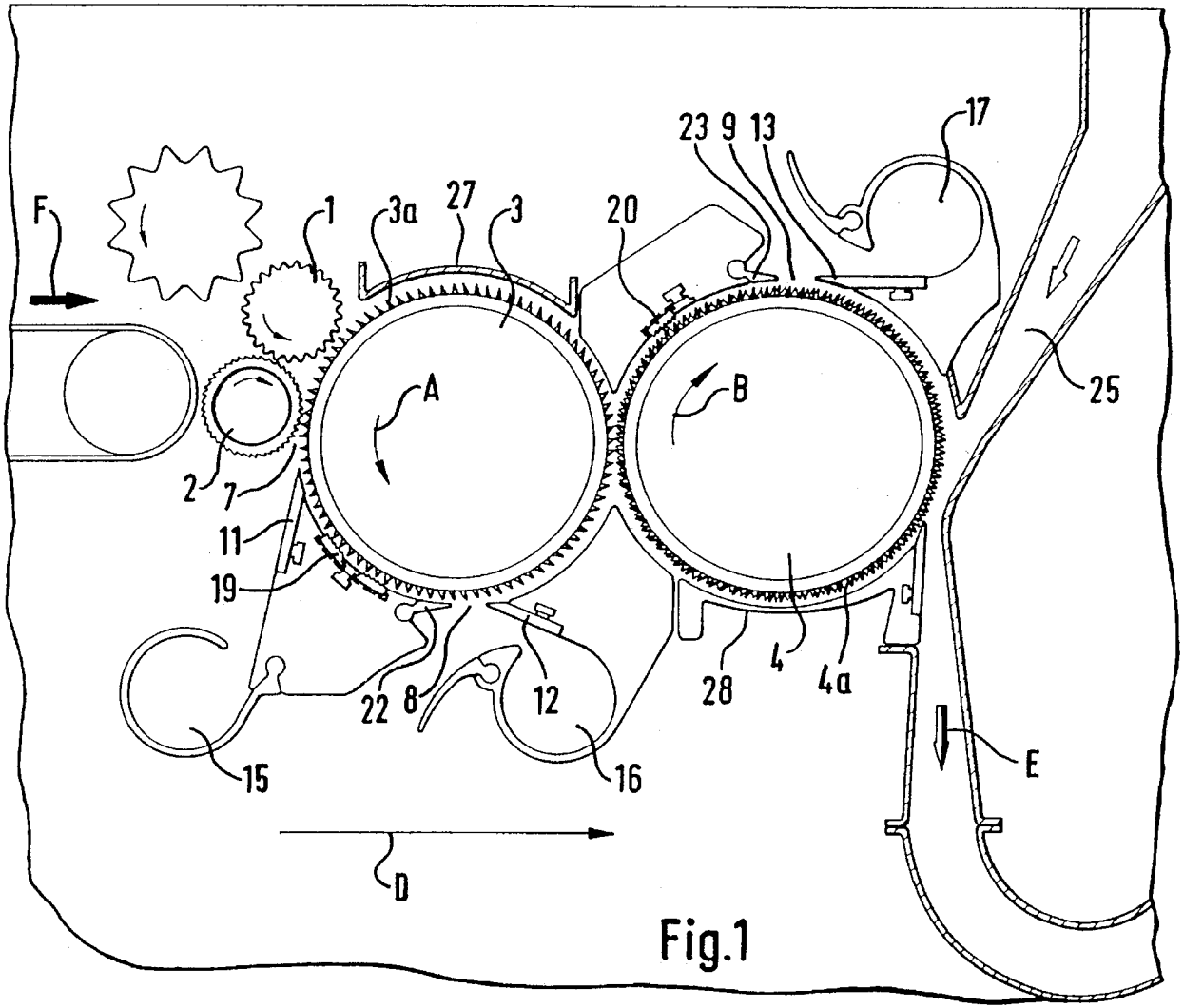
FIGS. 1, 2, 3, 4 and 5 are schematic sectional side elevational views of different preferred embodiments of the invention.

Turning to FIG. 1, there is illustrated therein a fiber cleaning apparatus which is accommodated in a closed housing and which may be of the general construction of an RST model, manufactured by Trützschler GmbH & Co. KG, Mönchengladbach, Germany. As indicated by the arrow F, the fiber material to be cleaned is advanced to a feeding device on a belt conveyor. The working direction of the cleaner is designated by the arrow D. The fiber material consists of a fiber tuft mass, particularly cotton. The feeding device, formed of two cooperating feed rolls 1 and 2, advances the fiber mass under a clamping effect to a fully spiked roll 3 which is rotatably supported in the cleaner housing and which is driven counterclockwise as indicated by the arrow A. The fully spiked roll 3 is a known type of clothed fiber processing roll in which the clothing is formed of individual spikes of a typical spike length of 12 mm and a typical spike point density of $4/in^2$ (about $0.6/cm^2$).

Downstream of the fully spiked roll 3, as viewed in the direction of fiber feed, a coarse sawtooth roll 4 is positioned which rotates clockwise as indicated by the arrow B. The coarse sawtooth roll 4 is a known type of clothed fiber processing roll in which the clothing is formed of a helically wound strip configured as a sawtooth blade. The sawtooth height is typically 7.5 mm and the sawtooth point density is typically $10/in^2$ (about $1.5/cm^2$). Both rolls 3 and 4 may have a diameter of approximately 150–300 mm. The fully spiked roll 3 is, at the top, covered by a housing portion 27. With the fully spiked roll 3 there is associated a waste discharge opening 7 through which fiber impurities pass and which is bounded by a mote knife 11. The size of the waste discharge opening 7 is adapted to the degree of soiling of the fiber material. In the direction of rotation of the fully spiked roll 3, downstream of the discharge opening 7, an additional waste discharge opening 8 and associated mote knife 12 are positioned. With each mote knife there is associated a suction hood designated at 15 and 16, respectively. The coarse sawtooth roll 4 is associated with a waste discharge opening 9, a mote knife 13 and a suction hood 17.

In the description which follows, the operation of the above-described apparatus will be set forth.

The fiber mass, such as a loose fiber lap formed of fiber tufts is advanced by the feed rolls 1 and 2 under a clamping effect to the fully spiked roll 3 which combs the fiber material and entrains bunches of fiber on its spikes 3*a*. As the fully spiked roll 3 carries the material in front of the waste discharge opening 7, short fibers and coarse impurities are thrown out of the material through the waste discharge opening 7 by centrifugal forces. After passing through the waste discharge opening 7 the waste is admitted to the suction hood 15. The fiber material pre-cleaned in this manner is taken over by the points of the teeth 4*a* of the coarse sawtooth roll 4 from the fully spiked roll 3 and the material is further opened. As the material is carried by the coarse sawtooth roll 4 in front of the discharge opening 9, further impurities are thrown out of the fiber material by centrifugal forces.

The fully spiked roll 3 is particularly adapted to process large fiber tufts or lumps because of the relatively great spike length. The coarse sawtooth roll 4 has a relatively large volume between the sawtooth to allow a takeover of the relatively coarse fiber material from the fully spiked roll. The opening roll series described above in connection with FIG. 1 permits a relatively high output rate.

In accordance with another embodiment of the invention, a cleaner according to FIG. 1 is provided except that the fully spiked roll is replaced by a needle roll and the coarse sawtooth roll is replaced by a medium sawtooth roll. The needle roll differs from the fully spiked roll essentially in that the needle roll has a clothing formed of individual spikes of a typical spike length of 6 mm and a typical spike point density of $10/in^2$. A medium sawtooth roll differs from a coarse sawtooth roll in that the sawtooth height is typically 6 mm and the sawtooth point density is typically $19.5/in^2$ (about $3/cm^2$). In this two-roll combination the needle roll permits a processing of smaller fiber tufts, particularly because its spikes of shorter length. The medium sawtooth roll is utilized because the smaller fiber tufts have already been opened to a greater extent by the needle roll. Such a series performs a highly satisfactory opening and cleaning work.

According to a third two-roll embodiment, in the above-described second embodiment the medium sawtooth roll is replaced by a fine sawtooth roll. The fine sawtooth roll may be structured identically to a coarse sawtooth roll or a medium sawtooth roll, except that the tooth point density is typically $32.2/in^2$ (about $5/cm^2$). The sawtooth height is typically that of the medium sawtooth roll, that is, 6 mm. In this third combination of rolls the needle roll serves the same purpose as in the second embodiment while the fine sawtooth roll effects a greater cleaning by performing an even more pronounced opening. This combination is advantageously used with certain fiber material, such as ripe cotton.

Figure 2:
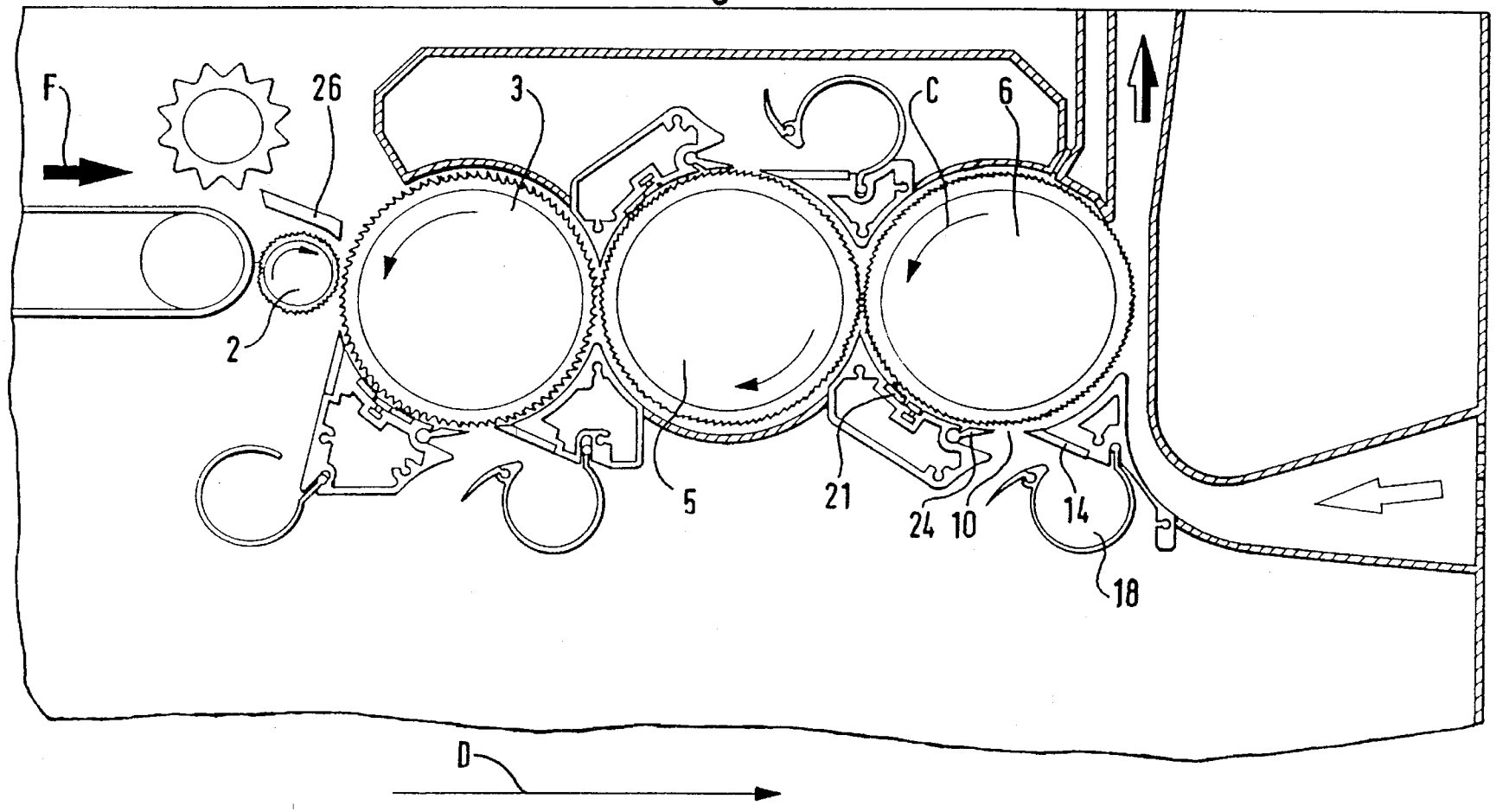

A fourth embodiment of the invention is illustrated in FIG. 2 where the roll series is formed of three fiber processing rolls. The first roll 3 is a fully spiked roll, followed by a second roll 5 which is a needle roll. The third roll 6 is a fine sawtooth roll. Dimensional characteristics of the clothing of each of these three rolls have been discussed earlier in connection with the various two-roll series. In this three-roll series the fully spiked roll 3 is intended to process large fiber tufts; that is, it allows the infeed of such fiber tufts which are grasped by the long spikes and are accommodated in the intermediate spaces between the spikes. The needle roll 5 has a certain volume between the needles which permits the takeover of large fiber tufts from the fully spiked roll 3 in an advantageous manner. The fine sawtooth roll 6 is characterized by a superior final cleaning by means of an intensive opening. The three-roll series provides for a step-down processing resulting in an even better degree of cleaning. With such an embodiment particularly an intended high trash separation with minimum useful fiber loss is feasible.

While in the embodiment according to FIG. 1, the feeding device is formed of two cooperating feed rolls 1 and 2, in the structure illustrated in FIG. 2, the feeding device is formed of the feed roll 2 and a feed table 26 situated above the feed roll 2 and cooperating therewith. It will be understood that a feeding device of the type shown in FIG. 1 may replace that shown for FIG. 2 and, conversely, the feed roll/feed table arrangement of FIG. 2 may be utilized in the FIG. 1 construction in lieu of the feed rolls 1, 2.

The fine sawtooth roll 6 is associated with a waste discharge opening 10 bounded by a mote knife 14 and associated with a suction hood 18 for pneumatically removing waste material passing from the fiber material through the discharge opening 10.

Figure 3:
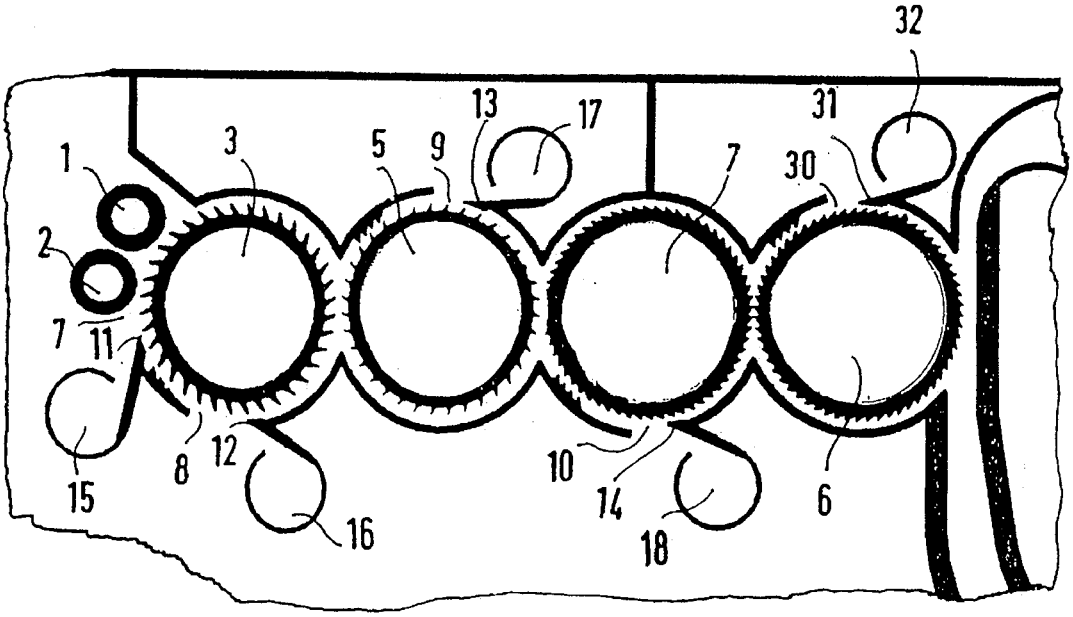

FIG. 3 illustrates an embodiment of the invention, having an opening device formed of a four-roll series. In this embodiment the first roll 3 is a fully spiked roll, the second roll 5 is a needle roll, the third roll 7 is a medium sawtooth roll and the fourth roll 6 is a fine sawtooth roll. In this arrangement the fully spiked roll 3 may receive and the needle roll 5 may take over large fiber tufts. The medium sawtooth roll 7 and the fine sawtooth roll 6 provide for a fine opening and fine cleaning. Such a four-roll machine is actually a combination of two machines: a pre-opener operating with a fully spiked roll and a needle roll on the one hand and a fine opener operating with a medium sawtooth roll and a fine sawtooth roll on the other hand. The four-roll cleaner of FIG. 3 has the same multiple trash removal features as the two-roll embodiment illustrated in FIG. 1 and the three-roll embodiment illustrated in FIG. 2. Thus, in the FIG. 3 embodiment cooperating feed rollers 1 and 2 advance the fiber material to the first roll 3 which is associated with circumferentially spaced waste discharge openings 7 and 8 as well as mote knives 11, 12 and suction hoods 15 and 16. The second roll 5 cooperates with a waste discharge opening 9 as well as a mote knife 13 and a suction hood 17 and the third roll 7 cooperates with a waste discharge opening 10 as well as a mote knife 14 and a suction hood 18. The fourth fiber processing roll 6 cooperates with a waste discharge opening 30, a mote knife 31 and a suction hood 32.

Figure 4:
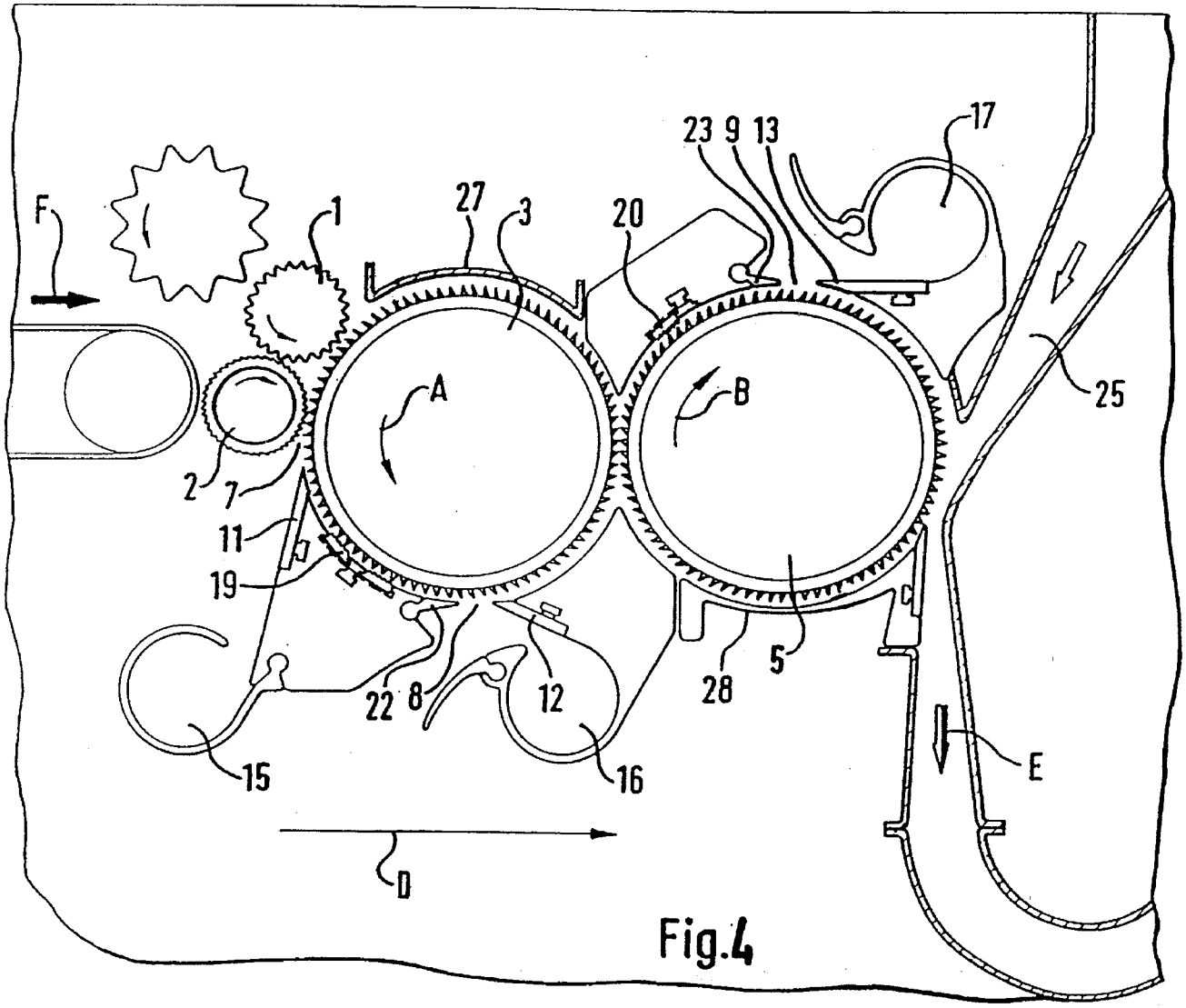

A further embodiment of the invention is illustrated in FIG. 4 which operates with a two-roll series composed of a fully spiked roll 3 (first roll) and a needle roll 5 (second roll). In this arrangement the fully spiked roll 3 may receive and the needle roll 5 may take over large fiber tufts from the fully spiked roll. This series makes possible a particularly gentle handling of the fiber material and therefore fiber tufts of the type that are particularly difficult to open may be satisfactorily gently handled with this embodiment.

In all of the above-described embodiments, with the last downstream roll of the respective series, as viewed in the working direction D, a pneumatic fiber doffing device 25 is associated which removes the fiber material from the last roll by a tangential air stream as indicated by the arrow E.

Further, in all embodiments of the invention, each fiber processing roll may be associated with stationary carding elements, such as elements 19, 20, 21 shown in FIG. 2. Further, as shown in FIG. 1, the waste discharge openings 8 and 9 are bordered by respective guide elements 22 and 23 which are adjustable (movable) for varying their distance from the respective roll 3 or 4.

Figure 5:
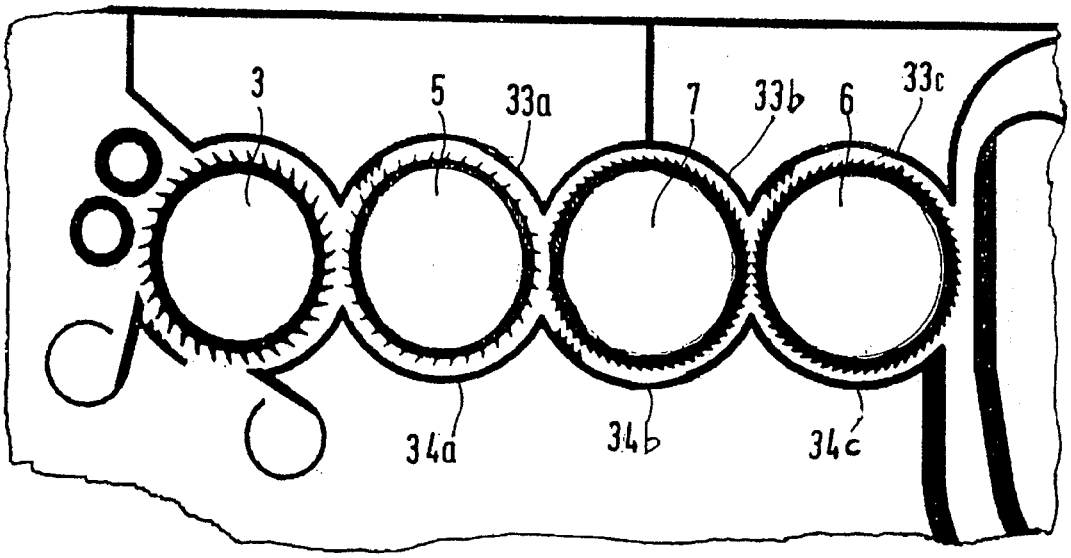

In all the above-described embodiments each fiber processing roll of the opening device cooperates with a waste discharge opening, a mote knife and a suction duct. Such an arrangement is particularly adapted to treat cotton fiber. In case chemical fiber is processed, in all embodiments expediently only the first roll (that is, the roll which directly receives the fiber material from the fiber feeding device 1, 2 or 2, 26) has a waste discharge opening, a mote knife and a suction duct, whereas all the remaining rolls of the series are entirely shrouded as illustrated in FIG. 5 showing upper housing portions 33*a*, 33*b* and 33*c* and lower housing portions 34*a*, 34*b* and 34*c* which together circumferentially substantially completely enclose (shroud) the respective rolls 5, 7 and 6.

It will be understood that the above description of the present invention is susceptible to various modifications, changes and adaptations, and the same are intended to be comprehended within the meaning and range of equivalents of the appended claims.

What is claimed is:

1. In an apparatus for cleaning and opening fiber tufts, including a feeding device and an opening device adjoining the feeding device for receiving fiber tufts therefrom; the improvement wherein said opening device comprises a series of immediately consecutive fiber processing rolls each having a point density; said point density increasing from roll to roll as viewed in a direction of fiber material advance through the roll series of the opening device; said series being formed of a first roll receiving fiber material from said feeding device, a second roll receiving fiber material from said first roll, a third roll receiving fiber material from said second roll and a fourth roll receiving fiber material from said third roll; said first roll being a fully spiked roll having spikes of a length of about 12 mm and a spike point density of about $0.6/cm^2$, said second roll being a needle roll, said third roll being a medium sawtooth roll having sawteeth of a length of about 6 mm and a sawtooth point density of about $3/cm^2$ said fourth roll being a fine sawtooth roll having sawteeth of a height of about 6 mm and a sawtooth point density of about $5/cm^2$.

2. The apparatus as defined in claim 1, further comprising a stationary carding element adjoining each roll of said opening device.

3. The apparatus as defined in claim 1, further comprising means defining a waste discharge opening adjoining each roll of said opening device; and a mote knife bordering each said waste discharge opening.

4. The apparatus as defined in claim 1, further comprising a guide element bordering at least some of said waste discharge openings; and means for adjustably supporting each said guide element for varying a distance thereof from a respective said roll of the opening device.

5. The apparatus as defined in claim 1, further comprising a pneumatic fiber removal means for doffing fiber material from a last downstream roll of said opening device.

6. The apparatus as defined in claim 1, wherein one of the rolls of the series is an upstream roll cooperating with said feeding device for directly receiving fiber material therefrom; further comprising means defining a waste discharge opening cooperating with said upstream roll; and a mote knife bounding said waste discharge opening; every roll of said series situated downstream of said upstream roll as viewed in said direction of fiber material advance being substantially entirely circumferentially closed by a housing portion.

* * * * *